US005158190A

United States Patent [19]

Sosenko

[11] Patent Number: 5,158,190

[45] Date of Patent: Oct. 27, 1992

[54] BEVERAGE CONTAINER WITH GRIPPING STRUCTURE

[76] Inventor: Ron Sosenko, 90 Gold St., Suite 11K, New York, N.Y. 10038

[21] Appl. No.: 660,697

[22] Filed: Feb. 25, 1991

[51] Int. Cl.[5] ..... B65D 23/00; B65D 23/10

[52] U.S. Cl. ..... 215/1 R; 215/100 A

[58] Field of Search ..... 215/1 R, 100 A, 1 C; D9/370, 391, 396

[56] References Cited

U.S. PATENT DOCUMENTS

| | | | |
|---|---|---|---|
| D. 48,813 | 4/1916 | Dawson | 215/1 R X |
| D. 67,760 | 7/1925 | Metropol | D9/391 |
| D. 104,696 | 5/1937 | Mas | D9/396 |
| D. 112,190 | 11/1938 | Bireley | D9/391 |
| D. 113,154 | 1/1939 | Wellman | 215/1 R X |
| D. 179,507 | 1/1957 | Barbiers | D9/391 |
| D. 184,391 | 2/1959 | Du Pree | D9/370 X |
| 1,648,344 | 11/1927 | Hatcher | 215/1 R |
| 2,142,811 | 1/1939 | Agonis | 215/1 R |
| 2,772,704 | 12/1956 | McConnell et al. | 215/1 R X |
| 3,013,686 | 12/1961 | Blunt | 215/1 R X |

*Primary Examiner*—Sue A. Weaver

*Attorney, Agent, or Firm*—George A. Skoler

[57] ABSTRACT

A beverage container possessing multiple sections comprising a neck portion in which is located the container opening, a rounded section below the neck portion having a diameter substantially greater than that of the neck portion, a waist section below the rounded section having a diameter less than that of the rounded section and greater than that of the neck portion, and a base section having sloping sides extending from the waist section to about the bottom of the container and containing indented grip sections and stippling on the base section.

10 Claims, 1 Drawing Sheet 2
3
4
5
6
7
8
9
10
11
12
13
15
17

BEVERAGE CONTAINER WITH GRIPPING STRUCTURE

BRIEF DESCRIPTION OF THE INVENTION

The invention relates to beverage container possessing multiple sections comprising a neck portion in which is the container opening, a rounded section below the neck portion having a diameter very much greater than that of the neck portion, a waist section below the rounded section having a diameter less than that of the rounded section and greater than that of the neck portion, and a base section having sloping sides extending from the waist section to about the bottom of the container. The container contains indented grip sections and stippling on the base section.

BACKGROUND TO THE INVENTION

Beverage containers take many forms, from the distinctive Coke TM bottle to the bland aluminum can. Few beverage containers are designed to fit one's grip; to avoid slipping from the hand when wet and to be easily handled in almost any circumstance. This is especially the case with glass beverage containers that, because of their weight and easily wettable surfaces, are often times hazardous to handle. There is a need in the beverage industry for comfortably fitting glass beverage bottles that reduce the chance of being dropped.

THE INVENTION

This invention relates to a novel beverage container comprising:

(a) a single opening to an open interior and an oppositely positioned base;

(b) round internal walls concentrically positioned about a common axis for the opening and the base as well;

(c) multiple external sections containing (i) a rounded neck converging at the container's opening, (ii) a rounded mid-section below the neck having a diameter, determined perpendicular to the common axis, very much greater than that of the neck, (iii) a waist below the rounded mid-section having a diameter less than that of the rounded section and greater than that of the neck, and (iv) a base section having sloping sides extending from the waist to about the bottom of the container.

The container contains indented grip portions and protruding stippling on the base section. The protruding stippling is desirably a plurality of small rounded bulges that essentially uniformly speckle the outside surface of the base section except at the location of the grip sections. The grip portions are adjacent concave-like slots, on the outer surface of the base section, aligned essentially perpendicular to the common axis.

Preferably, the outer diameter of the base section, determined perpendicular to the common axis, is greater than the diameters of the neck and the rounded mid-section. Also preferred, the base section contains 2 or 3 concave-like slots located within one quadrant of it defined by a 90° angle radiating perpendicularly from the common axis. Preferably, the container is a glass bottle.

DETAILED DESCRIPTION OF THE INVENTION

Figures 1, 2, 3:
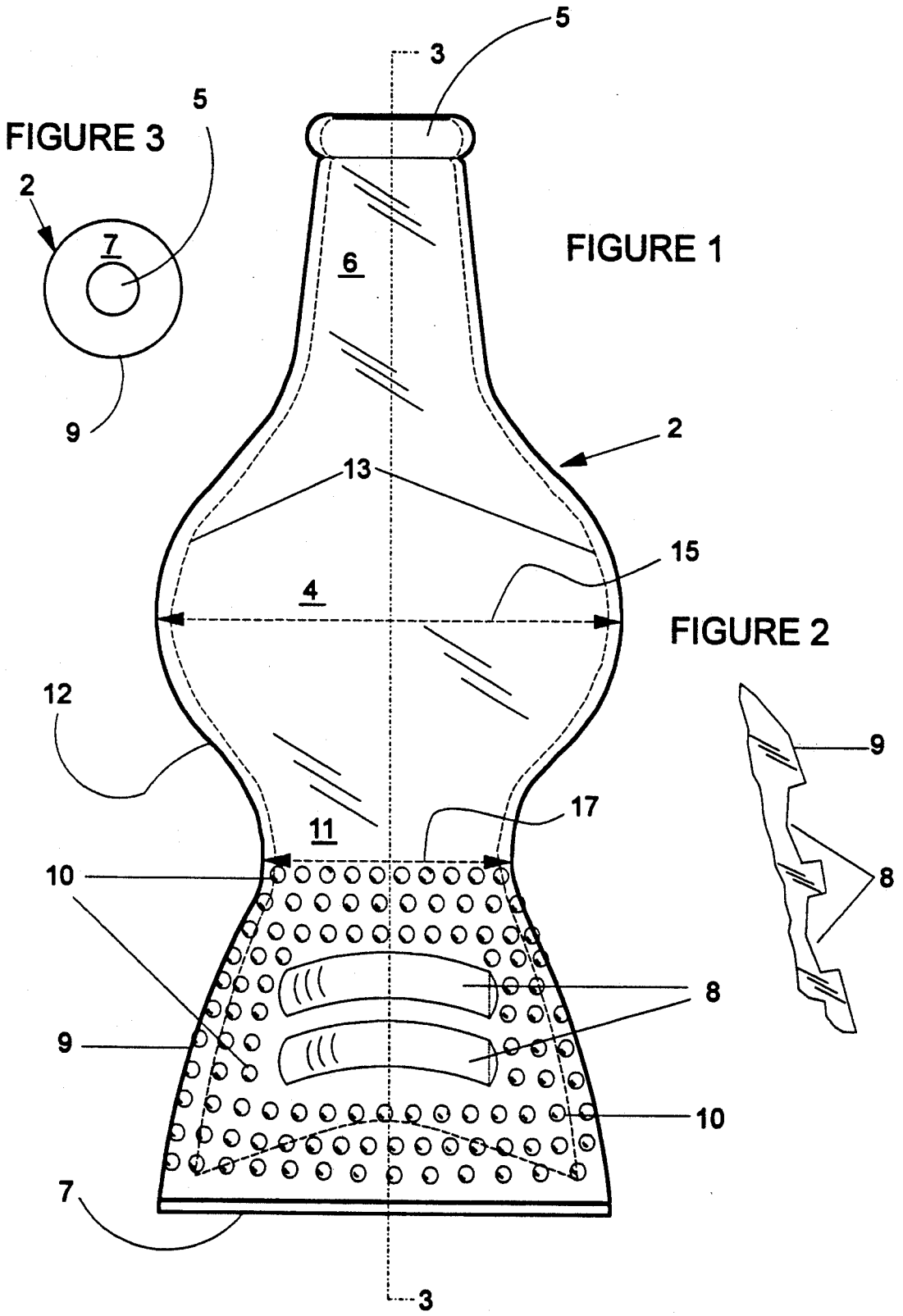
FIG. 1 is a side illustration of the beverage container of the invention.
FIG. 2 is a cut-away section partial cross-section of the base section of the beverage container of FIG. 1.
FIG. 3 is a bottom view of the beverage container of FIG. 1.

FIG. 1 illustrates glass beverage bottle 2 possessing neck 6, mid-section 4 and base section 9. FIG. 3 shows that bottle 2 has a general cylindrical shape with a common axis as to all peripheral surfaces. Neck 6 ends at opening 5 and can be sealed with a pressure fitted cap (not shown) in the common manner.

The outer surfaces of bottle 2, on any perpendicular cross-sectional plane, are equidistant from the central axis passing through the centers of base 7 and opening 5. Mid-section 4 in combination with neck 6 appear as an inverted bulb resting on waist section 11. Waist 11 comprises the smallest diameter cross-sectional plane, perpendicular to the common axis, between mid-section 4 and base section 9. Base section 9 is similar to a truncated cone, providing an ever increasing diameter to essentially the base 7 of bottle 2. Dotted about and protruding from the exterior surface of base section 9 are rounded bulges 10. This stippling effect provides an excellent grip surface, aiding in the handling of bottle 2.

The cross-sectional diameters, determined perpendicular to the central axis, at the widest sections of mid-section 4 and base section 9, may be the same or different. In the typical case, the diameter of mid-section 4 will be slightly less than the diameter of base section 9, so that in filling the bottles using automated equipment, the base sections will butt rather than the mid-sections. This assures stability of each bottle in the filling operation and the likelihood of less breakage.

Neck 6 may be a smooth surface, as shown, and be used to accommodate a label. It may also be provided with a stippled surface much like base section 9. In addition, mid-section 4 need not be circular in either its side or cross-sectional shape. In some cases, the side view of the mid-section maybe slightly flattened to facilitate adding a conventional label to the bottle. In terms of this invention, round or rounded is not intended to be limited to a circular shape when viewed either from the side or cross-sectionally. Thus, diameter, as used herein, means the diameter of a round surface and is not limited to the diameter of a circle.

Coextensively aligned on the outer surface of base 9 are slots 8. Each may have a width ranging from as little as about 0.5 inch to as wide as about 1 inch, though each is more likely to range from 0.5 to less than about 1 inch. Though FIGS. 1 and 2 show 2 slots, more slots may be used. Generally, the maximum number of slots will be 3. As shown, the slots are spaced apart, but they may abut and share a common wall which may or may not rise to the plane of the outer surface.

As shown, the slots have bow shapes. This allows them to be as effective to grip with either one's left or right hand. In the preferred embodiment, each slot is an arc with their ends directed toward base 7. FIG. 2 shows each slot 8 as gouged into base section 9, concave-like, so that a finger comfortably fits into each of them.

The interior 13 of bottle 2 will typically conform, exactly or generally, to the shape of its exterior 12. It is not essential to the invention that the thickness of the walls of bottle 2 be uniform though sometimes it will be desirable to have them so.

In use, one grips bottle 2 with a hand around base section 9 such that the index finger or the middle finger or both rests in slots 8. The thumb then extends about or toward the other side of bottle 8 and abuts a portion of the downside curve of mid-section 4. In this fashion, the thumb and fingers support bottle 2 via support surfaces, to wit, slots 8 and mid-section 4. When bottle 2 is tilted into the pouring position, i.e., inverted so that opening 5 faces downwardly, and base 7 faces upwardly, the truncated-conical shape of base 9 serves as a support to the holder such that the pouring action is easier to control. The result is an easier bottle to handle and carry about for all purposes.

I claim:

1. A beverage container comprising:

a) a single opening to an open interior and an oppositely positioned base;

b) round internal walls concentrically positioned about a common axis for the opening and the base as well;

c) multiple external sections containing i) a rounded neck converging at the container's opening, ii) a rounded mid-section below the neck having a diameter, determined perpendicular to the common axis, greater than that of the neck, iii) a waist below the rounded mid-section having a diameter less than that of the rounded mid-section and greater than that of the neck, and iv) a base section having sloping sides extending at an ever increasing diameter from the waist to about the base of the container, containing indented grip portions and protruding stippling.

2. The beverage container of claim 1 wherein the protruding stippling is a plurality of small rounded bulges that essentially uniformly speckle the outside surface of the base section except at the location of the grip sections.

3. The beverage container of claim 2 wherein the grip portions are concave-like slots, next to each other, in the outer surface of the base section that are aligned essentially perpendicular to the common axis.

4. The beverage container of claim 1 wherein the outer diameter of the base section, determined perpendicular to said common axis, is greater than the diameters of the neck section and the rounded mid-section.

5. The beverage container of claim 4 wherein the base section contains at least one of 2 and 3 concave-like slots as the indented grip portions located within one quadrant thereof defined by a 90° angle radiating perpendicularly from the common axis.

6. The beverage container of claim 1 wherein the container is made of glass.

7. The beverage container of claim 2 wherein the container is made of glass.

8. The beverage container of claim 3 wherein the container is made of glass.

9. The beverage container of claim 4 wherein the container is made of glass.

10. The beverage container of claim 5 wherein the container is made of glass.

* * * * *